US005310972A

United States Patent [19]

Spanio

[11] Patent Number: 5,310,972

[45] Date of Patent: May 10, 1994

[54] SNAP-ACTION DEVICE FOR COOPERATING WITH TOOTHED WHEELS OR THE LIKE, IN PARTICULAR FOR USE IN ELECTRICAL CHANGE-OVER OR OTHER SWITCHES

[75] Inventor: Marino Spanio, Milan, Italy

[73] Assignee: Bremas S.p.A., Italy

[21] Appl. No.: 906,370

[22] Filed: Jun. 30, 1992

[51] Int. Cl.[5] ..... H01H 3/8

[52] U.S. Cl. ..... 200/336; 200/565; 74/527

[58] Field of Search ..... 200/565, 336, 419, 564, 200/11 TW; 74/527

[56] References Cited

U.S. PATENT DOCUMENTS

| | | | |
|---|---|---|---|
| 3,430,514 | 3/1969 | Speelman | 74/527 |
| 4,511,770 | 4/1985 | Hayashida | 200/564 X |
| 5,009,120 | 4/1991 | Iseler et al. | 74/527 X |
| 5,055,644 | 10/1991 | Alsch | 200/336 X |

*Primary Examiner*—Renee S. Luebke

*Attorney, Agent, or Firm*—Steinberg, Raskin & Davidson

[57] ABSTRACT

A snap-action device, for use in electrical switches, which includes at least one toothed wheel, a switch having a base with a shoulder guide and a cylindrical wall for supporting the toothed wheel, with an inclined portion at opposite ends thereof, at least one spring, and a pawl having a pawl base and side walls with at least one surface inclined along the pawl base. The pawl is slidably attached to the shoulder guide and connected to the switch by snapping steps on the pawl onto corresponding counter-steps on the switch to prevent accidental separation of the pawl from the switch. At least one tang is arranged with the surface of the side walls and the portions of the cylindrical wall to define a cavity wherein the spring is inserted and pre-loaded.

19 Claims, 1 Drawing Sheet

SNAP-ACTION DEVICE FOR COOPERATING WITH TOOTHED WHEELS OR THE LIKE, IN PARTICULAR FOR USE IN ELECTRICAL CHANGE-OVER OR OTHER SWITCHES

BACKGROUND OF THE INVENTION

This invention relates to a snap-action device for cooperating with toothed wheels, in particular for use in change-over or other electrical switches or the like.

Electrical change-over switches usually comprise a shaft for shifting the contact unit, this shaft being connected to a toothed wheel. This latter cooperates generally with two opposing pawls, each loaded by a spring.

The usual pawls generally have a substantially U-shaped profile and rest with their base on horizontal guides which also act as the support for the loading spring.

Said pawls are very difficult to mount. To do this, the spring has to be preloaded, then inserted into the appropriate seat for the pawl and the pawl finally positioned on the guides along which it slides.

The small dimensions of the elements which have to be handled make these operations even more complicated. In addition, after the pawl has been correctly mounted and positioned, if the pawl is accidentally knocked or if the toothed wheel is not inserted correctly, it can escape from its housing seat urged by the spring, in which case it has to be remounted.

OBJECTS AND SUMMARY OF THE INVENTION

An object of the present invention is to provide a snap-action device of the aforesaid type which is easy to mount reliably, so reducing the assembly time and hence cost of the electrical change-over switch or the like which uses the device. This and further objects which will be apparent to the expert of the art are attained by a snap-action device for cooperating with toothed wheels or the like, in particular for use in electrical change-over or other switches, the body of said change-over switch comprising a usual cylindrical wall for supporting at least one usual toothed wheel and symmetrical about a first axis, comprising a pawl the body of which is symmetrical about a second axis and comprises a base, side walls and a cavity for containing at least one elastic means, characterised in that said pawl comprises means for connecting the pawl to the body of the change-over switch to prevent accidental separation of the pawl, and at least one tang inclined to said second axis, said walls comprising at least one surface inclined to said base to facilitate the insertion of the elastic means into said cavity and its pre-loading, said cylindrical wall comprising at its ends at least one portion inclined to said first axis and arranged to cooperate with said inclined surfaces in order to pre-load said elastic means. The present invention will be more apparent from the accompanying drawing, which is provided by way of non-limiting example and in which:

DETAILED DESCRIPTION OF THE PREFERRED EMBODIMENTS

The snap-action device comprises substantially a pawl indicated overall by 1 (FIGS. 1–5), a loading spring 2 (FIGS. 7 and 8) and a guide 3 (FIG. 6 and 8) extending from the base 23 of the body of a change-over switch 8 (FIGS. 6 and 8) incorporating the device according to the invention.

Figure 1:
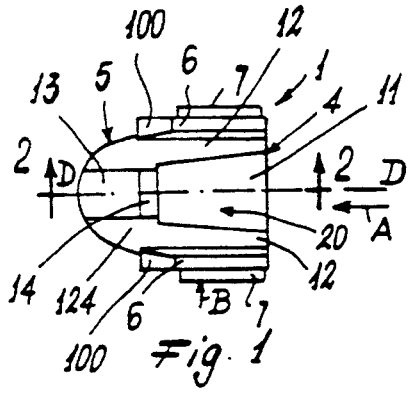
FIG. 1 is a view from below of a part of the snap-action device according to the invention.
Figure 2:
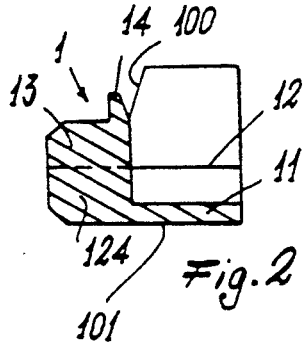
FIG. 2 is a cross-section therethrough on the line 2—2 of FIG. 1.
Figure 3:
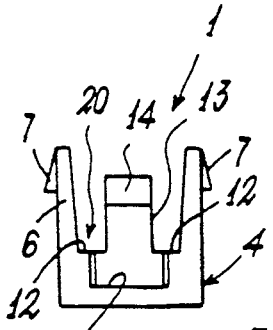
FIG. 3 is a view thereof in the direction of the arrow A of FIG. 1.
Figure 4:
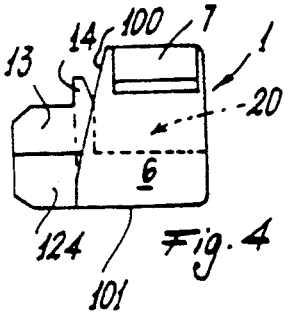
FIG. 4 is a view thereof in the direction of the arrow B of FIG. 1.
Figure 5:
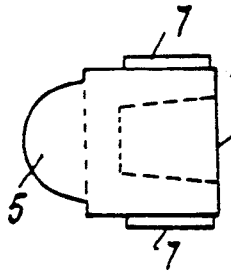
FIG. 5 is a plan view thereof.

The pawl 1 (shown in detail in FIGS. 1–5) comprises a cavity 20 defined by a first substantially U-shaped part 4 (FIG. 3) joined to a second semi-cylindrical part 5 (FIG. 5).

The two side walls 6 (FIG. 4) of the U-shaped part 4 are substantially trapezoidal and comprise at the two free ends of their outer surface a step 7 for snap-connection, during the assembly of the device, to a counter-step 9 (FIG. 7) provided on the wall 10 (FIG. 7) of the change-over switch 8.

The two side walls 6 also comprise (FIG. 4) a surface 100 inclined at an angle of about 75° to the base 101 of the pawl (this value is preferred but not limiting, the angle being able to vary from 30° to 90°) to facilitate the fitting of the pawl of the body of the change-over switch and the pre-loading of the spring 2, as described hereinafter.

Figure 7:
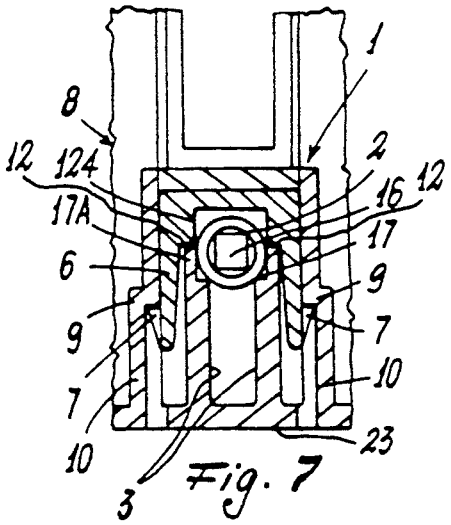
FIG. 7 is a cross-section therethrough on the line 7—7 of FIG. 6.
Figure 8:
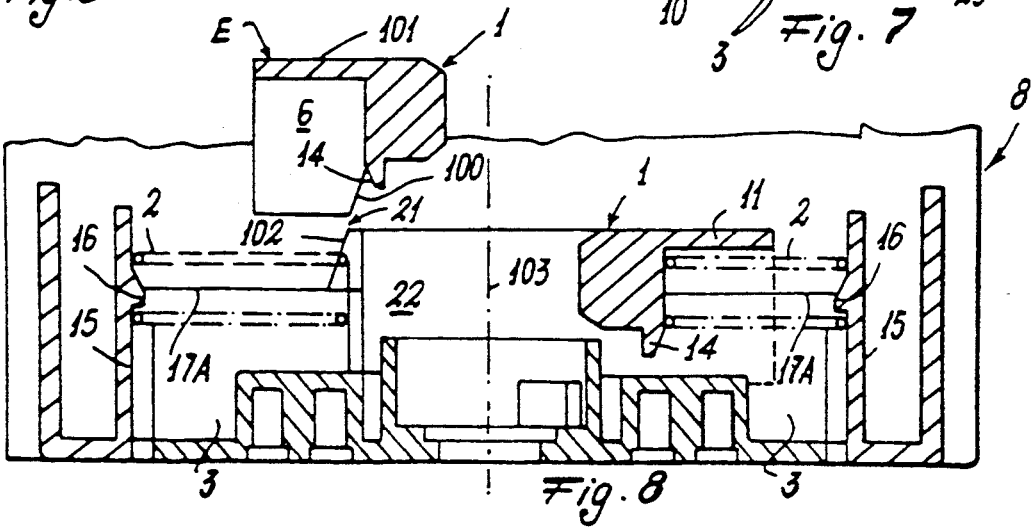
FIG. 8 is a longitudinal section through two snap-action devices according to the invention, one of which is fitted to the body of a partly illustrated electrical change-over switch (of the type shown in FIGS. 6 and 7), the other being shown in the correct position for its fitting.

Internally the U-shaped part 4 has a trapezoidal base 11 (FIG. 1) from which the side walls 6 extend. Each of these latter comprises, in proximity to the base 11, a slide surface 12 (FIGS. 3, 2, 7, 1) which extends to the second semi-cylindrical part 5 of the pawl 1, and rests on a shoulder 17A of the slide guides 3 (as shown in FIG. 7) when the pawl 1 is associated with the change-over switch 8.

A parallelepiped element 13 extends, parallel to the pawl axis D—D (FIG. 1), from the base 124 of the second semi-cylindrical part 5 of the pawl 1. An inclined tang 14 (see FIGS. 2 and 4) extends from that lateral surface of the element 13 which faces the base 11. Advantageously, this tang is inclined by an angle of 70° to the pawl axis D—D (this value is preferred but not limiting, the angle being able to vary from 20° to 90°). The described pawl 1 is applied to the body of the change-over switch 8 (or the like), which for this purpose comprises the described shoulders 10 (FIG. 7) for snap-fitting the pawl to the body of the change-over switch, the guide 3 (FIG. 7) and a further wall 15 (FIG. 8), This latter is provided at one end with a step 16 (FIGS. 8, 6, 7) for retaining the spring 2 when this is loaded.

As stated, the guide 3 comprises a shoulder 17A on which the pawl surface 12 slides, and a step 17 which acts as a support surface for the spring 2.

The body of the change-over switch 8 also comprises a substantially cylindrical wall 22 (FIGS. 6 and 8) for supporting a usual toothed wheel 24, the ends 21 of said wall comprising two portions 102 inclined by an angle of about 15° to the axis 103 of the cylindrical surface (this value is preferred but not limiting, the angle being able to vary from 0° to 60°).

Figure 6:
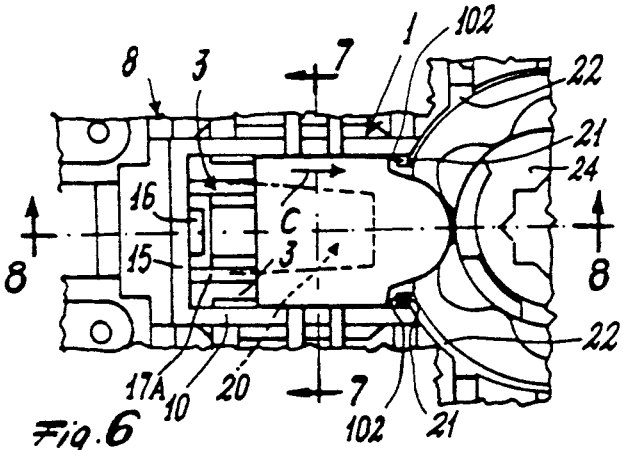
FIG. 6 is a plan view of a snap-action device according to the invention used in an electrical change-over switch and cooperating with a toothed wheel (these latter shown only partly)

The portions 102 cooperate with the inclined surfaces 100 of the walls 6 of the pawl to facilitate its assembly (as described hereinafter) and block its travel in the direction of the arrow C (FIG. 6).

The device is assembled in the following manner.

The spring 2 is rested on the guides 3 such that one end is penetrated by the step 16. The pawl is then positioned such that the inclined surfaces 100 are aligned with the inclined portions 102 of the guide shoulders 17A (see FIG. 8, the pawl being indicated by the arrow E). The pawl base 101 is then pushed so that the inclined surfaces 100 slide on the inclined portions 102 and the tang 14 of the pawl rests on the free end of the spring 2, to hence achieve the desired pre-loading of the spring 2 in a simple and effective manner.

By virtue of this pushing action the steps 7 on the pawl snap into the respective counter-steps 9 in the shoulders 10 of the body of the change-over switch 8, so reliably locking the pawl in its operating position.

What is claimed is:

1. A snap-action device for cooperating with toothed wheels for use in electrical change-over switches, said device comprising:

a change-over switch having a body comprising a cylindrical wall for supporting at least one toothed wheel, said cylindrical wall being symmetrical about a first axis;

a pawl having a body which is symmetrical about a second axis and comprising a pawl base, side walls, and a cavity for containing at least one elastic means;

connecting means for attaching said pawl to said body of said change-over switch to prevent accidental separation of said pawl from said switch, said connecting means comprising steps on said pawl arranged to cooperate with corresponding counter-steps provided on said cylindrical wall of said body of said change-over switch; and at least one tang inclined along said second axis, said side walls of said pawl comprising at least one surface inclined from said pawl base to facilitate insertion and pre-loading of said elastic means into said cavity, said cylindrical wall having opposing ends, each of said opposing ends having at least one portion arranged to cooperate with said surfaces of said side walls of said pawl in order to pre-load said elastic means.

2. The device as claimed in claim 1, wherein said tang is inclined at an angle between 20° and 90°.

3. The device as claimed in claim 1, wherein said surfaces of said side walls of said pawl are inclined at an angle between 30° and 90°.

4. The device as claimed in claim 1, wherein said portions of said cylindrical wall of said change-over switch are inclined at an angle between 0° and 60°.

5. The device as claimed in claim 1, wherein said cavity of said pawl is defined by said side walls forming a substantially U-shaped part and a semi-cylindrical part, said U-shaped part having a trapezoidal base.

6. The device as claimed in claim 1, wherein said elastic means are at least one spring.

7. A snap-action device for use in electrical switches, comprising:

at least one wheel having teeth on its periphery;

a switch having a body comprising a base and a cylindrical wall for supporting said wheel, said base having a guide with a shoulder, said cylindrical wall being symmetrical about a first axis and having opposing ends, each of said opposing ends having at least one inclined portion;

at least one elastic means;

a pawl having a body which is symmetrical about a second axis and comprising a pawl base and side walls, said side walls having at least one surface inclined along said pawl base, said pawl being slidably attached to said guide of said switch and being moveable in a substantially radial direction of said wheel;

connecting means for connecting said pawl to said body of said switch; and at least one tang inclined along said second axis, said tang arranged with said surface of said side walls of said pawl and said portion of said cylindrical wall of said switch to define a cavity, said elastic means being inserted and pre-loaded into said cavity.

8. The device in claim 7, wherein said tang is inclined at an angle between 20° and 90°.

9. The device in claim 7, wherein said surface of said side walls of said pawl are inclined at an angle between 30° and 90°.

10. The device in claim 7, wherein said portions of said cylindrical wall of said switch are inclined at an angle between 0° and 60°.

11. The device in claim 7, wherein said cavity of said pawl is defined by said side walls forming a substantially U-shaped part and a semi-cylindrical part, said U-shaped part having a trapezoidal base.

12. The device in claim 7, wherein said elastic means are at least one spring.

13. The device in claim 7, wherein said switch further comprises a step for retaining said elastic means when loaded in said switch and a wall for supporting said step.

14. A snap-action device for use in electrical switches, comprising:

at least one wheel having teeth on its periphery;

a switch having a body comprising a base and a cylindrical wall for supporting said wheel, said base having a guide with a shoulder, said cylindrical wall being symmetrical about a first axis and having opposing ends, each of said opposing ends having at least one inclined portion;

at least one elastic means;

a pawl having a body which is symmetrical about a second axis and comprising a pawl base and side walls, said side walls having at least one surface inclined along said pawl base, said pawl being slidably attached to said guide of said switch and being moveable in a substantially radial direction of said wheel;

connecting means for connecting said pawl to said body of said switch, said connecting means are steps arranged to cooperate with corresponding counter-steps provided on said cylindrical wall of said body of said switch; and at least one tang inclined along said second axis, said tang arranged with said surface of said side walls of said pawl and said portion of said cylindrical wall of said switch to define a cavity, said elastic means being inserted and pre-loaded into said cavity.

15. The device in claim 14, wherein said tang is inclined at an angle between 20° and 90°.

16. The device in claim 14, wherein said surface of said side walls of said pawl are inclined at an angle between 30° and 90°.

17. The device in claim 14, wherein said portions of said cylindrical wall of said switch are inclined at an angle between 0° and 60°.

18. The device in claim 14, wherein said cavity of said pawl is defined by said side walls forming a substantially U-shaped part and a semi-cylindrical part, said U-shaped part having a trapezoidal base.

19. The device in claim 14, wherein said elastic means are at least one spring.

* * * * *